US007091675B2

(12) United States Patent
Lin

(10) Patent No.: US 7,091,675 B2
(45) Date of Patent: Aug. 15, 2006

(54) DRIVING APPARATUS FOR COLD CATHODE FLUORESCENT LAMPS

(75) Inventor: Jyh Chain Lin, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 28 days.

(21) Appl. No.: 10/750,025

(22) Filed: Dec. 31, 2003

(65) Prior Publication Data

US 2004/0155606 A1 Aug. 12, 2004

(30) Foreign Application Priority Data

Dec. 31, 2002 (TW) ..... 91137948 A

(51) Int. Cl.
*H05B 37/00* (2006.01)

(52) U.S. Cl. ..... 315/294; 315/151; 315/159

(58) Field of Classification Search ..... 315/291, 315/224, 149–159, 307, 105, 172, 176, 294, 315/312, 324; 250/205
See application file for complete search history.

(56) References Cited

U.S. PATENT DOCUMENTS 5,418,432 A * 5/1995 Takeuchi et al. ..... 315/151
5,619,104 A * 4/1997 Eunghwa ..... 315/159
5,825,133 A * 10/1998 Conway ..... 315/105
5,900,701 A * 5/1999 Guhilot et al. ..... 315/307
6,104,146 A 8/2000 Chou et al. ..... 315/277
6,133,695 A * 10/2000 Caya et al. ..... 315/119
6,207,943 B1 * 3/2001 Smelker ..... 250/205
6,255,784 B1 * 7/2001 Weindorf ..... 315/291
6,307,331 B1 * 10/2001 Bonasia et al. ..... 315/294
6,404,143 B1 * 6/2002 Pilz et al. ..... 315/294
6,596,977 B1 * 7/2003 Muthu et al. ..... 250/205

FOREIGN PATENT DOCUMENTS

CN 00803711 3/2002

OTHER PUBLICATIONS

Coaton and Marsden, © Arnold and Contributors 1997, Lamps and Lighting 4th edition, p. 212, 213, 107.*

* cited by examiner

*Primary Examiner*—Wilson Lee
(74) *Attorney, Agent, or Firm*—Wei Te Chung

(57) ABSTRACT

A driving apparatus (2) for cold cathode fluorescent lamps (CCFLs) includes a primary and a secondary driving circuits (22, 21), a primary and a secondary light tubes (24, 23), a primary and a secondary feedback circuits (26, 27), and two photosensitive elements (25) corresponding to the primary and the secondary light tubes, respectively. The primary and the secondary driving circuits provide power to drive the primary and the secondary light tubes, respectively. The primary feedback circuit receives photoelectric current of a corresponding photosensitive element and provides an output signal to the primary driving circuit. The secondary feedback circuit receives currents of both photosensitive elements, and provides an output signal to the secondary driving circuit to keep a brightness of the secondary light tube the same as the brightness of the primary light tube.

13 Claims, 2 Drawing Sheets

DRIVING APPARATUS FOR COLD CATHODE FLUORESCENT LAMPS

BACKGROUND OF THE INVENTION

1. Field of the Invention

The present invention relates to power supply for a cold cathode fluorescent lamp (CCFL) system, and more particularly to an apparatus for driving each cold cathode fluorescent lamp (CCFL) in a multiple CCFL system.

2. Prior Art

Fluorescent lamps are used in a number of applications where light is required but the power required to generate light is limited. One such application is the backlight for a notebook computer or similar electronic device. One popular type of fluorescent lamp is a cold cathode fluorescent lamp (CCFL). This lamp typically requires a high starting voltage (about 1500 volts) for a short period of time, in order to ionize the gas contained within the lamp tube and thereby ignite the lamp. After the gas is ionized and the lamp is ignited, less voltage is needed to keep the lamp on.

FIG. 4 shows a conventional CCFL driving apparatus 1. The driving apparatus 1 includes a power supply 11, a buck pre-regulator 12, a self-resonating circuit 13, a CCFL 14, a resistor 15, a capacitor 16, a feedback circuit 17, and a pulse width modulation circuit 18. The CCFL 14, the capacitor 16, and the resistor 15 formed a closed loop.

The power supply 11 supplies a voltage to the buck pre-regulator 12, which regulates an operation current in the driving apparatus 1. The self-resonating circuit 13 receives the input current signal regulated by the buck pre-regulator 12, and outputs a high voltage (about 1500 volts) to start the CCFL 14. After that, the self-resonating circuit 13 outputs a lower voltage (about 600 volts) to maintain the CCFL in a steady illuminated state. The feedback circuit 17 receives a current signal from the closed loop, and feeds the current signal back to the pulse width modulation circuit 18. An output of the pulse width modulation circuit 18 is coupled to the buck pre-regulator 12, to provide a pulse width modulation signal thereto in order to modulate the duty cycle thereof.

The driving apparatus 1 also can be used to drive a multiple CCFL system, in which it is important to have balanced currents in all lamps in the system. The driving apparatus 1 provides a feedback circuit 17 to evenly distribute current through each of the CCFLs. However, in practice, characteristics of the CCFLs in the multiple CCFL system are not exactly the same as each other. Therefore, even when the operation currents in the CCFLs are equal to each other, there are still differences in the brightnesses between the various CCFLs. Furthermore, as the CCFLs randomly age after prolonged use, the differences in the brightnesses between the various CCFLs become even more pronounced.

Therefore, it is desirable to provide an improved driving apparatus which overcomes the above-described disadvantages of conventional driving apparatuses.

SUMMARY OF THE INVENTION

An object of the present invention is to provide a driving apparatus for a multiple CCFL system which enables the CCFLs thereof to have a same brightness.

In order to achieve the above-described object, a driving apparatus for CCFLs in accordance with the present invention includes a primary and at least a secondary driving circuits, a primary and at least a secondary light tubes, a primary and at least a secondary feedback circuits, and at least two photosensitive elements corresponding to the primary and said secondary light tubes, respectively. The primary and said secondary driving circuits provide power to drive the primary and said secondary light tubes, respectively. Photoelectric currents generated in said photosensitive elements alter according to respective brightnesses of the primary and said secondary light tubes. The primary feedback circuit receives the photoelectric current of a corresponding photosensitive element, and provides an output signal to the primary driving circuit. Said secondary feedback circuit receives at least two photoelectric currents of said photosensitive elements, and provides at least an output signal to said secondary driving circuit to keep the brightness of said secondary light tube the same as the brightness of the primary light tube.

Other objects, advantages, and novel features of the present invention will be apparent from the following detailed description of preferred embodiments thereof with reference to the attached drawings, in which:

DETAILED DESCRIPTION OF THE PRESENT INVENTION

Figure 1:
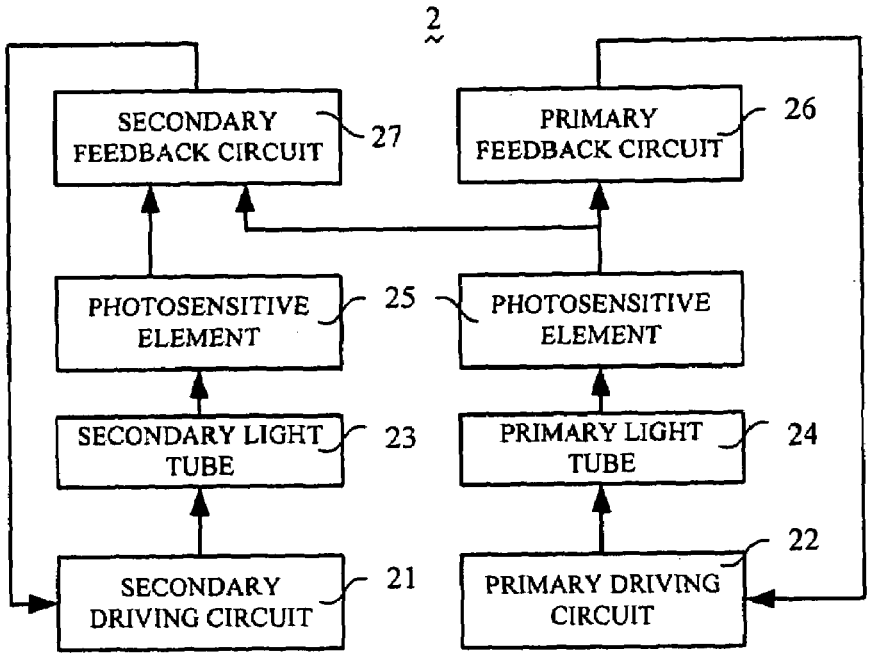
FIG. 1 is a block diagram of a multiple CCFL system driving apparatus of the present invention.

FIG. 1 is a block diagram of a multiple CCFL system driving apparatus 2 in accordance with an exemplary embodiment of the present invention. The driving apparatus 2 includes a primary driving circuit 22, a secondary driving circuit 21, a primary light tube 24, a secondary light tube 23, a primary feedback circuit 26, a secondary feedback circuit 27, and two photosensitive elements 25 disposed corresponding to the primary and secondary light tubes 24, 23. The photosensitive elements 25 can be photo resistors, photo diodes, or the like.

The primary and the secondary driving circuits 22, 21 provide power to drive the primary and secondary light tubes 24, 23, respectively. Each photosensitive element 25 generates a photoelectric current based on a brightness of the corresponding light tube 24, 23, respectively. The primary feedback circuit 26 receives a current of the corresponding photosensitive element 25 as an input signal, and provides an output signal to the primary driving circuit 22 for regulating and modulating a current in the primary light tube 24. The secondary feedback circuit 27 receives currents of both photosensitive elements 25 as input signals, and provides an output signal to the secondary driving circuit 21 for regulating a current in the secondary light tube 23. Such regulation keeps the brightness of the secondary light tube 23 the same as the brightness of the primary light tube 24.

Figure 2:
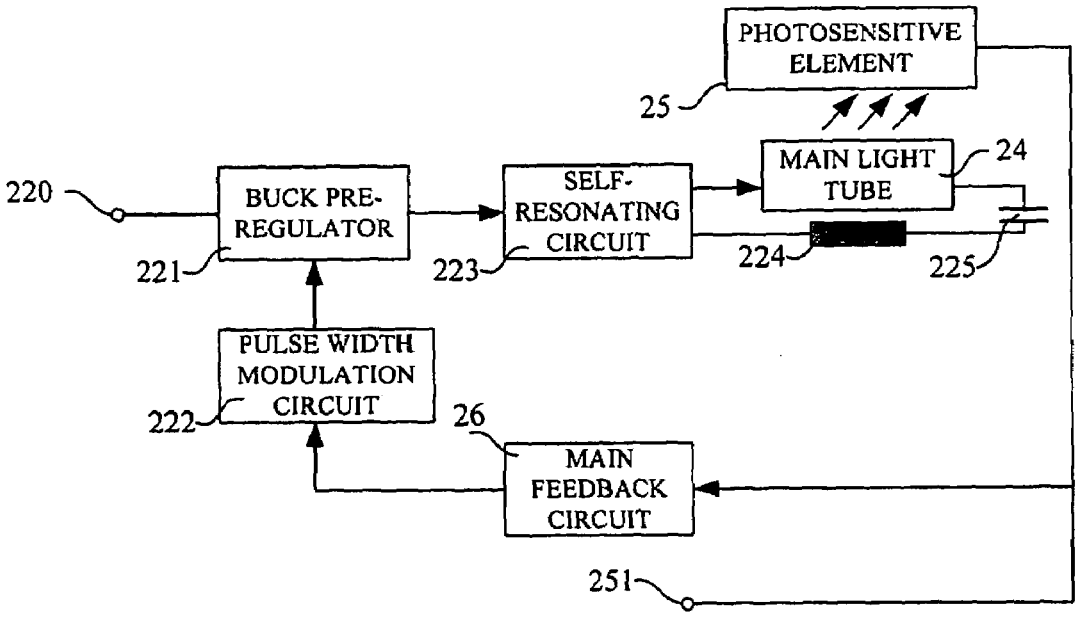
FIG. 2 is a block diagram of a primary driving apparatus for a primary light tube of the driving apparatus of FIG. 1.

FIG. 2 is a block diagram of a primary driving apparatus (not labeled) for the primary light tube 24 of the driving apparatus 2. The primary driving apparatus includes a power supply 220, a buck pre-regulator 221, a self-resonating circuit 223, a light tube 24 of a CCFL, a resistor 224, a capacitor 225, a photosensitive element 25, a primary feedback circuit 26, and a pulse width modulation circuit 222. The primary light tube 24, the capacitor 225, and the resistor 224 form a closed loop. A node 251 is for providing signals for a secondary driving apparatus, as described in detail below.

The power supply 220 supplies a voltage to the buck pre-regulator 221, which regulates an operation current in the primary driving apparatus. The self-resonating circuit 223 receives the operation current as an input signal regulated by the buck pre-regulator 221, and outputs a high voltage (about 1500 volts) to start the primary light tube 24. After that, the self-resonating circuit 223 outputs a lower voltage (about 600 volts) to maintain the light tube 24 in a steady illuminated state. The photosensitive element 25 generates a photoelectric current based on a brightness of the primary light tube 24. The feedback circuit 26 receives a current signal from the photosensitive element 25, and feeds the signal back to the pulse width modulation circuit 222. An output of the pulse width modulation circuit 222 is coupled to the buck pre-regulator 12 to provide a pulse width modulation signal thereto. Said signal modulates the duty cycle of the buck pre-regulator 12, for regulating and modulating the current in the primary light tube 24.

Figure 3:
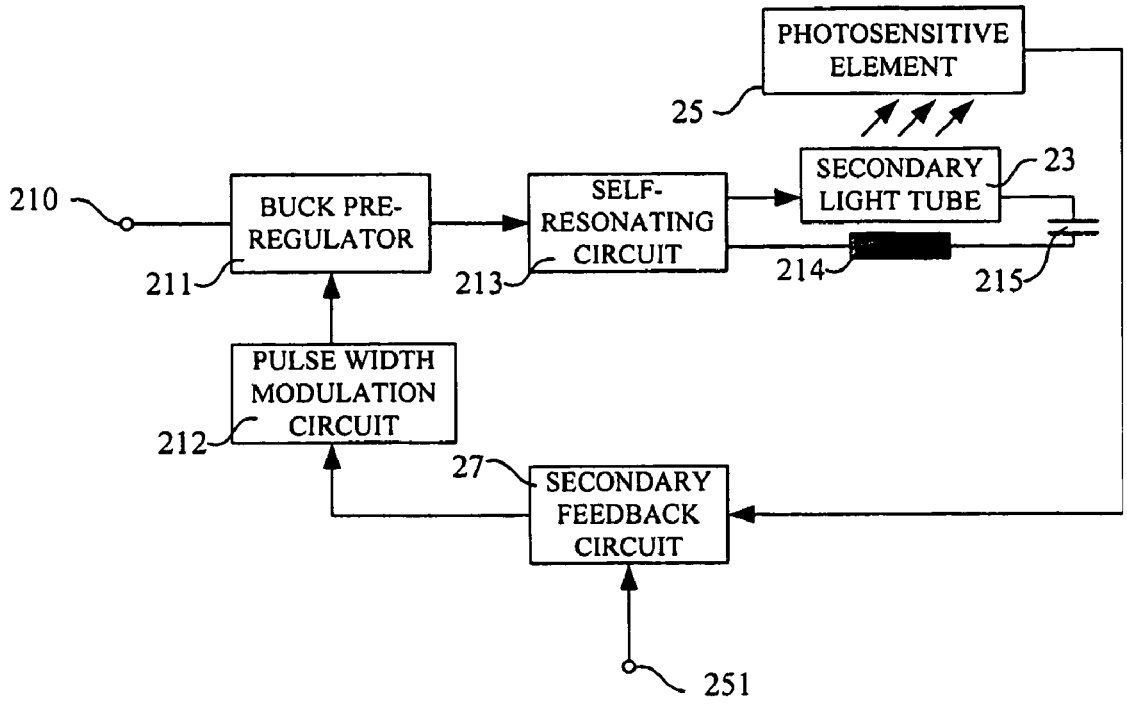
FIG. 3 is a block diagram of a secondary driving apparatus for a secondary light tube of the driving apparatus of FIG. 1.
Figure 4:
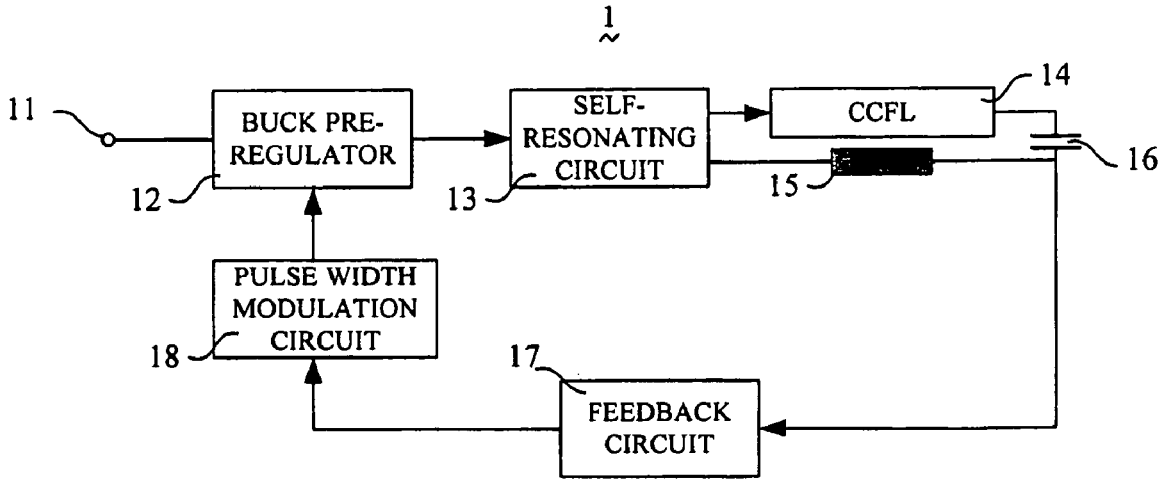
FIG. 4 (PRIOR ART)
FIG. 4 is a block diagram of a conventional CCFL driving apparatus.

FIG. 3 is a block diagram of the secondary driving apparatus, which is for the secondary light tube 23 of the driving apparatus 2. Elements of the secondary driving apparatus (not labeled) are similar to the elements of the primary driving apparatus (shown in FIG. 2 and described above). The secondary driving apparatus includes a power supply 210, a buck pre-regulator 211, a self-resonating circuit 213, a light tube 23 of a CCFL, a resistor 214, a capacitor 215, a photosensitive element 25, a secondary feedback circuit 27, and a pulse width modulation circuit 212. The secondary light tube 23, the capacitor 215, and the resistor 214 form a closed loop. The node 251 is for providing signals for the secondary driving apparatus.

The driving procedure of the secondary driving apparatus is similar to that of the primary driving apparatus. However, the secondary feedback circuit 27 receives current signals both from the photosensitive element 25 and from the node 251 as input signals. The secondary feedback circuit 27 feeds a signal back to the pulse width modulation circuit 212 based on the difference between the two received signals. An output of the pulse width modulation circuit 212 is coupled to the buck pre-regulator 211, to provide a pulse width modulation signal thereto in order to modulate the duty cycle thereof. The pulse width modulation circuit 212 provides an output signal to the buck pre-regulator 211. Said signal regulates a current in the secondary light tube 23, in order to keep the brightness of the secondary light tube 23 the same to the brightness of the primary light tube 24.

Although the driving apparatus 2 described above is in connection with a multiple CCFL system, it should be understood that a similar driving apparatus can be used to drive fluorescent lamps having filaments, neon lamps, and the like.

The driving apparatus 2 can be used to drive CCFLs and provide illumination in all kinds of electronic devices such as flat panel displays, personal digital assistants, palm top computers, scanners, facsimile machines, copiers, and the like.

In summary, the advantage of the driving apparatus 2 is that it enables the photosensitive elements 25 to detect the brightness of each light tube 24, 23 of the multiple CCFL system, and feeds back the photoelectric currents generated by the photosensitive elements 25 as input signals in order to regulate the operation currents in the light tubes 24, 23. This ensures that each light tube 24, 23 of the multiple CCFL system has the same brightness.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A driving apparatus for cold cathode fluorescent lamps, comprising:

a primary and at least a secondary driving circuits;

a primary and at least a secondary light tubes;

a primary and at least a secondary feedback circuits; and at least two photosensitive elements corresponding to the primary and said secondary light tubes, respectively;

wherein the primary and said secondary driving circuits provide power to drive the primary and said secondary light tubes, respectively, photoelectric currents of said photosensitive elements alter according to the respective brightness of the primary and said secondary light tubes, the primary feedback circuit receives the photoelectric current of a single corresponding photosensitive element and provides an output signal to the primary driving circuit, and said secondary feedback circuit receives at least two photoelectric currents of said photosensitive elements and provides at least an output signal to said secondary driving circuit in order to keep the brightness of said secondary light tube the same as the brightness of the primary light tube.

2. The driving apparatus as claimed in claim 1, wherein the photosensitive elements are photo resistors.

3. The driving apparatus as claimed in claim 1, wherein the photosensitive elements are photo diodes.

4. The driving apparatus as claimed in claim 1, wherein the primary driving circuit comprises a self-resonating circuit for providing a high voltage to start the primary light tube.

5. The driving apparatus as claimed in claim 4, wherein the primary driving circuit further comprises a buck pre-regulator coupled to the self-resonating circuit, for regulating an operation current of the primary light tube.

6. The driving apparatus as claimed in claim 5, wherein the primary driving circuit further comprises a pulse width modulation circuit coupled between the primary feedback circuit and the buck pre-regulator.

7. The driving apparatus as claimed in claim 6, wherein the pulse width modulation circuit receives an output signal of the primary feedback circuit, and controls a period of the buck pre-regulator.

8. The driving apparatus as claimed in claim 1, wherein said secondary driving circuit comprises a self-resonating circuit for providing a high voltage to start said secondary light tube.

9. The driving apparatus as claimed in claim 8, wherein said secondary driving circuit further comprises a buck pre-regulator coupled to the self-resonating circuit, for regulating an operation current of said secondary light tube.

10. The driving apparatus as claimed in claim 9, wherein said secondary driving circuit further comprises a pulse width modulation circuit coupled between said secondary feedback circuit and the buck pre-regulator.

11. The driving apparatus as claimed in claim 10, wherein the pulse width modulation circuit receives at least an output signal of said secondary feedback circuit, and controls a period of the buck pre-regulator.

12. An illumination system, comprising:

a primary sub-system including a primary driving circuit, a primary light tube, a primary photosensitive element and a primary feedback circuit connected in series; and at least one secondary sub-system including a secondary driving circuit, a second light tube, a secondary photosensitive element and a secondary feedback circuit connected in series;

wherein the primary photosensitive element is further linked to the secondary feedback circuit, the primary feedback circuit being confiaured so as to be solely influenced by the primary photosensitive element.

13. A method of providing an array of light tubes with consistent illumination, comprising steps of:

providing a primary sub-system including a primary driving circuit, a primary light tube, a primary photosensitive element and a primary feedback circuit connected in series; and providing at least one secondary sub-system including a secondary driving circuit, a secondary light tube, a secondary photosensitive element and a secondary feedback circuit connected in series;

wherein the primary sub-system and said at least one secondary sub-system are mainly separate from each other except the secondary feedback circuit is also influenced by said primary sub-system for obtaining consistent illumination between the primary sub-system and the secondary sub-system, the primary feedback circuit being configured so as to be solely influenced by the primary photosensitive element.

* * * * *